US007616771B2

(12) United States Patent
Lenhardt et al.

(10) Patent No.: US 7,616,771 B2
(45) Date of Patent: Nov. 10, 2009

(54) ACOUSTIC COUPLER FOR SKIN CONTACT HEARING ENHANCEMENT DEVICES

(75) Inventors: Martin Lenhardt, Hayes, VA (US); Douglas Richards, Virginia Beach, VA (US)

(73) Assignee: Virginia Commonwealth University, Richmond, VA (US)

( * ) Notice: Subject to any disclaimer, the term of this patent is extended or adjusted under 35 U.S.C. 154(b) by 693 days.

(21) Appl. No.: 10/476,158

(22) PCT Filed: Apr. 26, 2002

(86) PCT No.: PCT/US02/13081

§ 371 (c)(1),
(2), (4) Date: Apr. 20, 2005

(87) PCT Pub. No.: WO02/089525

PCT Pub. Date: Nov. 7, 2002

(65) Prior Publication Data

US 2006/0188115 A1 Aug. 24, 2006

(51) Int. Cl.
*H04R 25/00* (2006.01)

(52) U.S. Cl. ..... 381/326; 381/312; 381/380

(58) Field of Classification Search ..... 381/312, 381/315, 316, 326, 370, 380, 151; 600/25, 600/559; 607/55–57
See application file for complete search history.

(56) References Cited

U.S. PATENT DOCUMENTS 4,982,434 A * 1/1991 Lenhardt et al. ..... 381/326
5,772,575 A * 6/1998 Lesinski et al. ..... 600/25
6,068,589 A * 5/2000 Neukermans ..... 600/25

* cited by examiner

*Primary Examiner*—Huyen D Le
(74) *Attorney, Agent, or Firm*—Whitham, Curtis, Christofferson & Cook, P.C.

(57) ABSTRACT

There is provided hearing device improvements using modulation techniques adapted to the characteristics of auditory and vestibular hearing. One embodiment provides for extending hearing to the infrasonic range by extracting sounds from the high ambient noise in this range and applying them to a carrier in the ultrasonic quiet zone. Further extension of hearing into the ultrasonic range is provided by a modulation scheme which uses a fluid conduction coupler to match impedance for a vibration transducer applied to the skin. A variation on this embodiment integrates this ultrasonic hearing extension with normal acoustic headphones. Another embodiment compensates for high frequency hearing loss by a modulation scheme which uses middle ear resonance as an amplifier. A further embodiment combines ultrasonic transposition with wireless modulation to obtain secure communication.

6 Claims, 11 Drawing Sheets

ACOUSTIC COUPLER FOR SKIN CONTACT HEARING ENHANCEMENT DEVICES

BACKGROUND OF THE INVENTION

1. Field of the Invention

The present invention generally relates to hearing aids, and more particularly to devices which improve upon conventional hearing aids by using modulation techniques adapted to the characteristics of auditory and vestibular hearing.

2. Background Description

The traditional hearing aid is an air-conduction amplifying system such that a microphone picks up air conduction sounds, amplifies them and present them in the ear canals as an air conduction signal to the ear drum. These type of devices offer a small frequency range and also offer a small dynamic range of intensity.

Bone conduction hearing aids have also been developed for users where the conventional hearing aid is not satisfactory. A bone conduction device is attached to the head of the user and the output from a microphone pick-up is amplified and fed into this device which causes bone vibration. These devices operate over a small dynamic range and are designed principally for individuals whose middle ears could not be surgically repaired or for very young children who have abnormalities of the middle ear that cannot be surgically repaired until they are older. These bone conduction devices currently are rarely used.

The present invention is based in part on technology described in U.S. Pat. No. 4,982,434 to Lenhardt et al. ("Lenhardt, 1991"). That technology involves transposing air conduction sounds in the conventional or audiometric range which is a frequency range of about 100 to about 10,000 Hertz. These frequencies are shifted into the supersonic range which are frequencies above 20 kHz to about 108 kHz or higher and then transmit these supersonic frequencies by bone conduction or the like to the human sensory system. The hearing aid may transpose air conduction sound from the speech frequencies to the supersonic ranges in such a fashion that noise burst frequency modulated signals and quiet bursts that relate to speech frequencies will be shifted into the supersonic range. These signals are delivered by a bone conduction attachment such as a high fidelity electrical to vibrator transducer, preferably a piezoelectric type, functionally connected for bone conduction in the head.

It is hypothesized that the hearing aid and method described in Lenhardt 1991 is based on a system of hearing quite distinct from normal hearing based on air conduction. It utilizes bone conduction and parallels the primary hearing response of reptiles. In reptiles, there is no air conduction hearing, but hearing is mediated via the saccule which, in man, has been considered an organ responsible for balance and determining acceleration and movement. In reptiles, this organ is a hearing instrument and it possesses hearing potential in amphibia and in fish as well.

Phylogenetically, in evolution, hearing in fish, amphibia and reptiles is mediated by vibratory frequencies that work through vestibular systems. In amphibia, both bone and air conducted frequencies impinge on vestibular receptors. In reptiles, air conduction hearing is non-existent unless transduced via skin or bone to the vestibular saccule which is the primary hearing organ, as the cochlea does not exist. During evolution, as mammals evolved from reptiles, therapsids or amphibia, as gait, posture and skull evolved, so did the mammalian and avian cochlea which took over the role of the saccule as the primary hearing organ. The internal ear, or cochlea is now the primary mammalian acoustic contact with the external environment. The saccule, although equipped with the neuro-cortical functional capacity to ascertain sound became a back-up system of limited value, except for balance and motion detection. The awareness of the vestibular developmental role in evolutionary biology of hearing, was lost as physiologists expanded on our understanding of the role of air conduction with clinical emphasis on the physiology and pathology of the cochlea. Otolaryngologists, audiometrists, speech therapists, psychologists and physiologists look upon the saccule and utricular systems as accelerometers or motion detectors. The residual role of the saccule and vestibule in hearing perception is lost to current knowledge.

The hearing aid technology described in Lenhardt, 1991 is believed to utilize direct bone transmission to the saccule and this enables hearing to be maintained via a system independent of air conduction and the inner ear although integrated with the air conduction system. This provides a mechanism for allowing the nerve deaf to hear, but in addition, provides an alternative source of informational transfer independent of sounds moving through air. The sound is transmitted directly to the bones of the skull, and utilizes frequencies that are perceived by the saccule and not by the inner ear.

An advantage to utilization of the vestibule (saccule) as a hearing organ is that its response is transmitted via the vestibular nerve which can substitute for, or augment communication in, a damaged acoustic nerve. This is important in aging because of the relative longer functional life of the vestibular, nerve in aging. The vestibular nerve also provides an alternative to acoustic nerve injury that is of value in the sensory/neural deaf.

If hearing is viewed from a physical perspective, the cochlea is a collection of receptors linked to a mechanical device that matches the impedance of sound in air with that of sound in the cochlear fluid. If this cochlear transformer or transducer was not present most of the sound energy would be reflected away from the head. In contrast to the air mediated response of the cochlea, the otolithic organs in the vestibule, the saccule and utricle, respond to acceleration or body movement and inertial forces. The cochlea responds to sound pressure in similar fashion to a microphone while the saccule acts as an accelerometer which measures sound (vibration) in a solid medium.

The cochlea is sensitive to audiometric frequencies primarily in the range of 100 to approximately 10,000 Hertz. But the most important frequencies for a spoken voice are from 500 to 2500 Hertz. In the supersonic bone conduction technology described in Lenhardt, 1991 these frequencies are amplified and converted to a higher frequency. The frequency conversion or transposition shifts the frequency up from a normal audiometric range to the supersonic range which is above 20,000 Hertz and extends to approximately the 100,000 Hertz range. This transformation function may be linear, logarithmic, a power function or a combination of these and may be customized for each individual. To improve the recognition of the sounds being heard, the waveform may be modified by the waveform modification or signal processor. The supersonic signal may be modified to optimize the intelligibility of the signal. However, even without the waveform modification, the signal has a substantial intelligibility.

The supersonic bone conduction technology uses a transducer to apply the supersonic signals as supersonic vibrations to the skull, preferably at the mastoid interface. The transducer provides such vibrations at a frequency in the supersonic range and preferably from above 20,000 Hertz to approximately 100,000 Hertz. These frequencies are perceived as frequencies within a normal audiometric range by the brain and permit an intelligible understanding of what is being heard in the audiometric range even though the brain receives the signals primarily at supersonic frequencies. This is a key element of the prior art technology described in Lenhardt, 1991. Even though the frequencies are shifted to supersonic vibration frequencies they can still be interpreted by the brain as speech at audiometric frequencies.

The waveform modification may also include filters for certain bands which may have to be amplified further or some bands may have to be attenuated depending on how the signal is multiplied for customizing the hearing aid to the user. Customizing is not absolutely essential but can be used to improve the perceptual signal to the user so that it is a smooth speech perception that is balanced for the best perception.

Frequently, in voices, the low frequency will come in with the most intensity so low frequencies would in some cases be attenuated. Those frequencies that are critical for speech detection (500 to 2500 Hz) may be preferentially amplified. The signals can be cleaned to improve the speech perception by lumping some frequencies such as frequencies below 500 Hertz together and attenuating them. But the critical frequencies for voice communication between 500 Hertz and 2500 Hertz may be resolved so that small differences between the frequencies can be detected and discerned. The just noticeable differences (JND) of pitch varies at different frequencies generally in accordance with the 10% rule at supersonic frequencies. Pitch discrimination of young subjects show that at a tone of 2,000 Hertz, the JND is approximately 2 Hertz and at 15,000 Hertz the JND is approximately 150 Hertz. When the tone is 35,000 Hertz the JND is approximately 4,000 Hertz and at 40,000 Hertz the JND is 4500 Hertz. Thus, the 10% rule is that the JND is approximately 10% of the frequency of the tone and this extends into the supersonic region. So in addition to bunching or lumping together the low frequencies below 500 Hertz, the most important frequencies of 500 Hertz to 2500 Hertz are expanded when converted to supersonic frequencies so that the small differences in the frequencies can still be discerned under the 10% rule. Through bone conduction, the vibration frequencies in the supersonic range are perceived by the brain as the original audiometric frequencies. These signals can be modified to customize them to the individual subject and the transducer being used. This may be done through a combination of attenuation of some of the frequencies, a great amplification of some of the other frequencies and by wave shaping of the signal.

The state-of-the-art in noise control for hearing devices is active noise cancellation, which is effective for high frequencies, but ineffective for low frequencies and broad band noise. Most military operations occur in low frequency, broad band ambient noise. At present there is no good communication system for operation in a 120 dBA noise environment.

Conventional wisdom places the frequency range of human hearing between 20 Hz and 20 kHz. The upper limit is governed by the response of the basilar membrane with a center frequency of 20 kHz in the basal region. However, this region of the basilar membrane is capable of sensing frequencies up to 90 kHz or so with sufficient excitation. We refer to the 20 kHz-90 kHz ultrasonic band as the "quiet channel" of the auditory system. It has been shown (Lenhardt, 1991) that speech can still be recognized with 85% intelligibility when the frequencies are shifted into this range. Additionally, it is very difficult to mask these frequencies since the ambient noise ceiling is typically low. With sufficient power even deaf listeners can discriminate speech modulated by ultrasound (i.e. acoustic energy between 10 and 100 kHz) at a level of 40% correct. Ultrasonic hearing aids based on this finding are commercially available.

Ultrasound is audible either by bone or fluid conduction to the inner ear. The most efficient transfer path for ultrasound is with the transducer (actuator) interface on the skin over the mastoid bone, or the skin of the neck or side of the face over the massitor muscle. Detection is unlikely since ultrasound is not audible by air conduction (up to about 145 dB) unless there is some intermediary substrate or fluid coupling.

SUMMARY OF THE INVENTION

It is therefore an object of the present invention to provide improved operability of hearing devices in noisy conditions.

Another object of the invention is to extend hearing into the infrasonic and ultrasonic ranges so as to provide a full auditory experience.

A further object of the invention is to combine ultrasonic hearing technology with wireless communication to provide security.

It is also an object of the invention to provide an improved hearing device by using the natural resonance of the auditory system.

An object of the invention is to improve bone conduction hearing devices by minimizing energy losses from impedance differences between the transducer and the skin.

Yet another object of the invention is to enable listening for infrasonic frequencies by transposing these frequencies to the ultrasonic range.

The embodiments of the present invention build upon the prior art technology of supersonic bone conduction, the capability of the brain to interpret signals from both the acoustic and vestibular nerves, and the ability of the auditory system to respond to a greater sonic frequency range than is provided via the cochlea. The invention provides hearing device improvement embodiments that are enhancements for ultrasonic and bone conduction devices, using modulation techniques adapted to the characteristics of auditory and vestibular hearing.

One embodiment provides for extending hearing to the infrasonic range by extracting sounds from the high ambient noise in this range and applying them to a carrier in the ultrasonic "quiet zone." Low frequency audio signals, such as vehicle signatures, are captured by signal processing and then modulated on an ultrasonic carrier. The modulated signal is applied to a human auditory system.

Further extension of hearing into the ultrasonic range is provided using a fluid conduction coupler to match impedance for an ultrasonic modulation implemented by a vibration transducer applied to the skin. An input device for acoustic signals provides an analog output which is fed to a digital signal processor and then to a piezoelectric transducer, whose output is buffered by a water interface cushion providing a separation distance between the transducer and the skin contact, this separation distance being adjusted to provide an impedance match at a selected frequency between the transducer and the skin contact. A variation on this embodiment integrates this ultrasonic hearing extension with normal acoustic headphones.

Another embodiment compensates for high frequency hearing loss by a modulation scheme which uses middle ear resonance as an amplifier. High frequency audio signals are captured and an appropriate resonant frequency is identified and used to modulate the high frequency signals. The modulated signal is then applied to external ear, and is amplified because of resonance.

A further embodiment combines ultrasonic transposition with wireless modulation to obtain secure communication. An input device that is sensitive to signals at frequencies less than supersonic generates electrical signals as output; which are transmitted to a wireless receiver and applied to a supersonic bone conduction hearing aid. The frequencies of these signals are transposed to a supersonic range, either before or after transmission.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

The capability of the brain to interpret signals from both the acoustic and vestibular nerves, and the ability of the auditory system to respond to a greater sonic frequency range than is provided via the cochlea, coupled with the observed responsiveness of the brain to modulated signals, provide the basis for the present invention. The invention provides hearing device improvement embodiments that are enhancements for ultrasonic and bone conduction devices, using modulation techniques adapted to the characteristics of auditory and vestibular hearing.

Wireless Ultrasonic Hearing Aid

In one embodiment the invention is an improvement on the supersonic hearing aid in that the input is not restricted to a microphone sensitive in the audiometric frequencies. The input to the hearing aid can be airborne ultrasound, radiowaves (i.e. microwaves), infrared, frequency modulation, magnetic induction or a laser. The carrier can be modulated by natural or signal processed speech using amplitude, phase, pulsed modulation or the like. In the same sense, speech can be analog, digital or coded. The receptor at the listener will reflect the carrier but will not be a microphone sensitive in the audiometric range. The input to the wireless system can be an audiometric microphone, or any audio or electronic device including audio recorders, internet terminals, etc. This device could also be used with existing hearing aids, implants or other communication devices including those for music.

Figure 1:
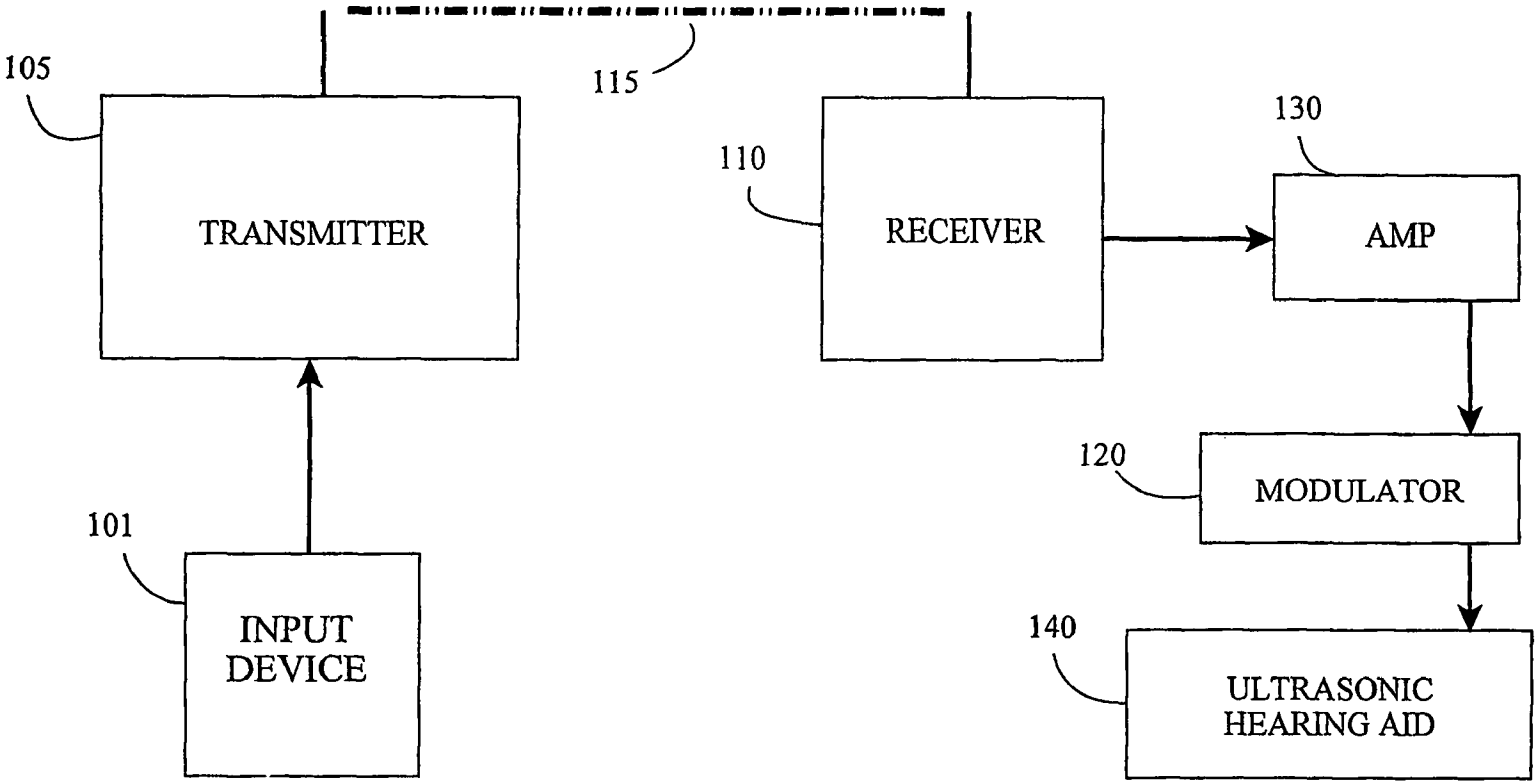
FIG. 1 is a schematic showing how elements of a wireless ultrasound hearing aid system are related.

FIG. 1 shows speech from an input device 101 transmitted by a transmitter 105 along wireless communication carrier 115 (e.g. using a radio frequency (RF) carrier) to a receiver 110 which demodulates the signal from the carrier. The signal is then modulated ultrasonically 120, after being amplified 130, and then is fed to the ultrasonic hearing aid 140. In this embodiment the output of the modulator 120 is fed directly into the ultrasonic hearing aid. Alternatively, in another embodiment, the ultrasonic modulator 120 is positioned on the transmitter side of wireless carrier 115, in which case the output of receiver 110 may be supplied to the ultrasonic hearing aid 140 directly or via amplifier 130. It is to be noted that the transmission 115 may be accomplished by a variety of carriers, including air ultrasound, laser, infrared and fm.

Figure 2A:
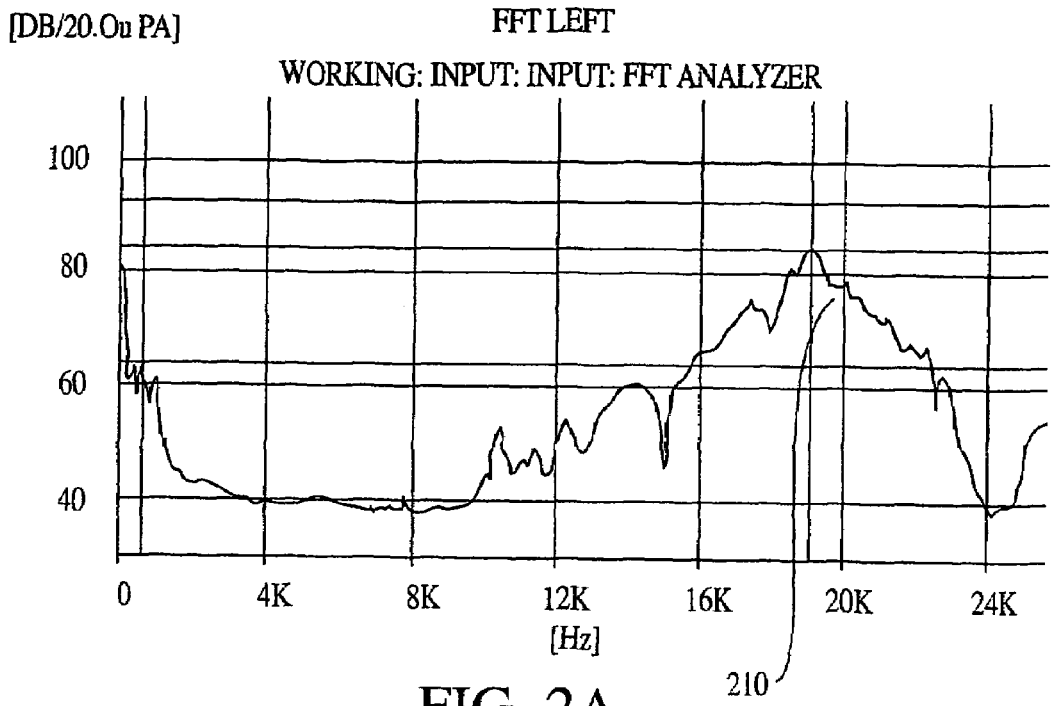
FIGS. 2A and 2B show waveform outputs for an ultrasonic hearing aid, in a quiet room (2A) and with room noise (2B).
Figure 2B:
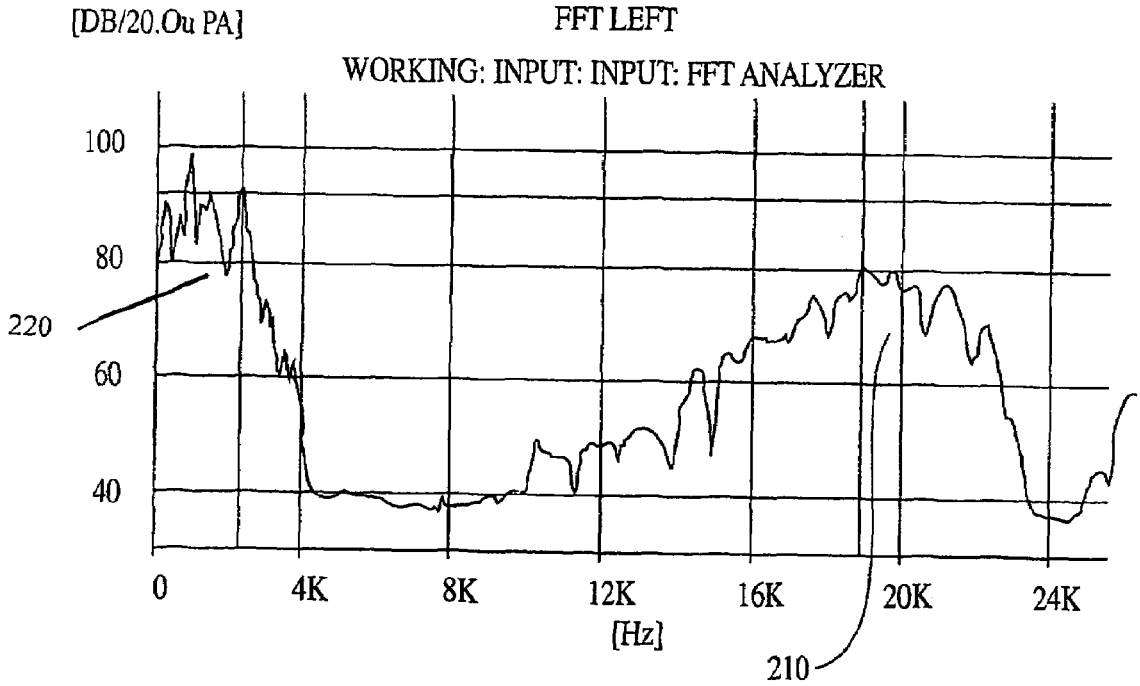

The practical effects of ultrasound modulation of the speech signal are shown in FIGS. 2A and 2B. In FIG. 2A there is shown a waveform output from the ultrasonic hearing aid in a quiet room, where the speech signal 210 appears on the ultrasonic carrier. In FIG. 2B there is shown increased room noise below 4 KHz, but this does not interfere with the speech signal 210 on the ultrasonic carrier.

Lenhardt, 1991 teaches only modulating audiometric frequencies typical of hearing aid applications. In this improvement the speech energy is modulated again on radio waves, allowing covert secure ultrasonic communication. Applications include military and covert communication.

Audioboost Using Natural Resonance

Another embodiment uses the natural resonance of the middle ear. The transfer function of the coupled external and middle ears can be simplified as essentially a low pass filter. The coupled resonance is about 2.8-3 kHz. As a result essential speech energy such as consonant sounds (sibilants, fricatives etc.) require more energy than vowels to be passed equally into the inner ear. With high frequency hearing loss the problem is more acute. Three approaches have been used in the prior art to compensate for the loss of high frequencies. The first is simply to amplify the speech to increase audibility. The result is usually discomfort and poor compliance in 80% of those who could profit from correct amplification. The second approach is the use of a bone conduction hearing aid. The problem with this is that unless the signal is above the conventional audiometric range, the ossicles are still activated after inertia is overcome, producing some annoying phase problems. The third approach is invasive, requiring attachment of shakers and related manipulation of the ossicles to overcome the natural frequency of vibration and pass high frequency information.

Alternatively, in accordance with one embodiment of the invention, high frequency information in the speech waveform can be multiplied by the natural frequency and can be transferred to the inner ear without the disadvantages of excessive power by sampling, taking advantage of the natural amplification present at resonance. This is not invasive and is not bone conduction and offers high frequency speech cues not found in traditional hearing devices.

Figures 3A, 3B:
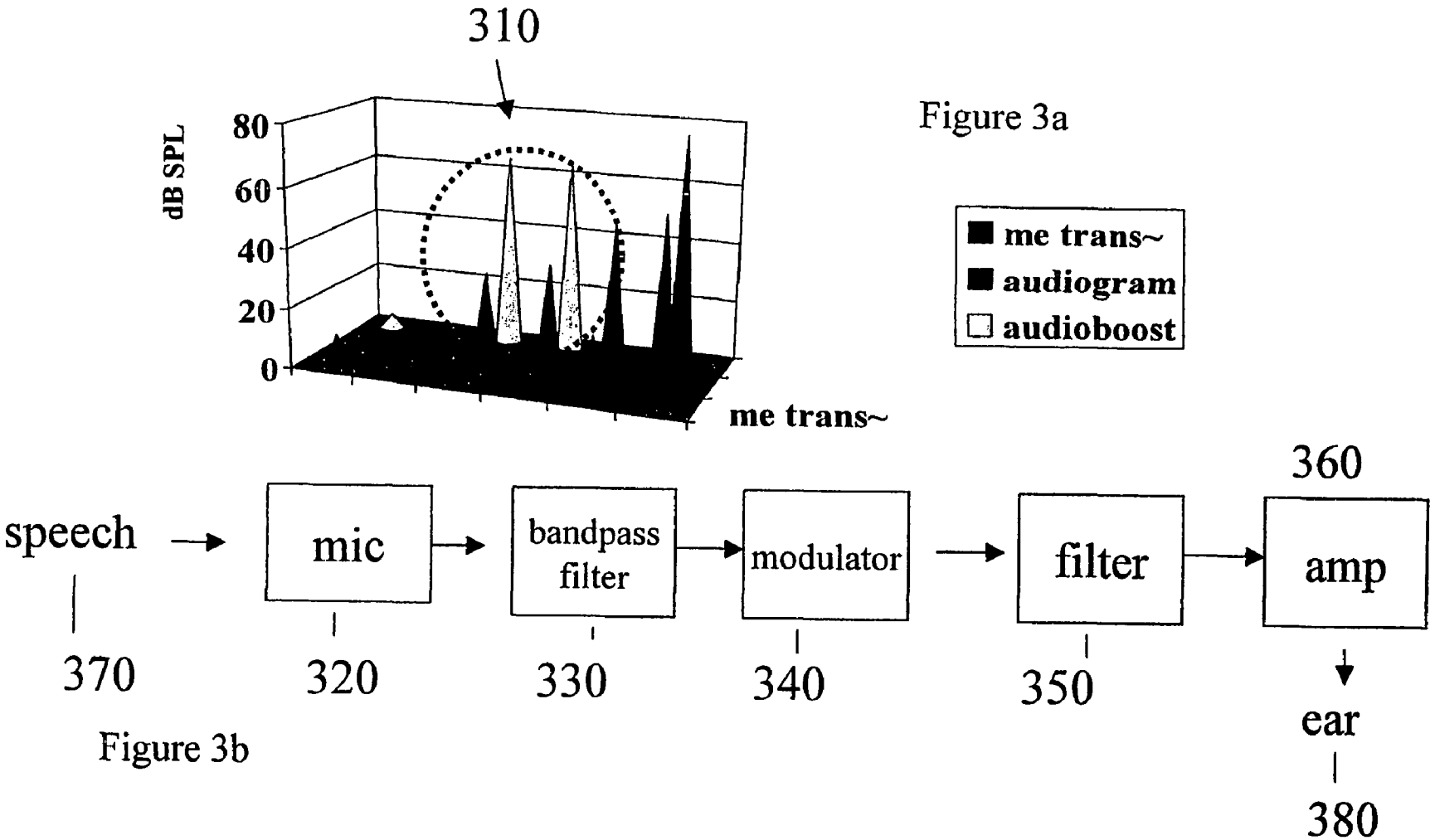
FIG. 3A is histogram showing amplification of an auditory resonance frequency coupled device for enhancing hearing aids.
FIG. 3B is a flow diagram for operation of an auditory resonance frequency coupled device.

The auditory system has many resonances. When energy is delivered at resonance, there is amplification. This embodiment of the invention is a modulation scheme that multiplies the speech spectrum of interest on the middle ear resonance, yielding a boost in perception with little energy costs. This is shown in FIG. 3B, where the speech spectrum of interest in speech 370 is selected by a bandpass filter 320 through mic 330 and then modulated 340 at a resonance frequency before being filtered 350 and amplified 360 for the ear 380. This embodiment uses a software algorithm at the modulator 340 that can be applied to air as well as bone conduction hearing aids. This algorithm provides for multiplication of the speech band of interest by the middle ear resonant frequency, which can be from approximately 2000 to 3000 Hz, determined clinically before hearing aid fitting. Any type of modulation is possible including, but not limited to, full AM, FM, phase or pulsed plus all variants thereupon as upper sideband lower sideband, carrier suppressed, etc. The advantage of this approach is to deliver frequencies higher than the ear's natural resonance to the cochlea without typical attenuation by the low pass filtering of the middle ear. The middle ear's limitation is used in this embodiment as an advantage, as may be seen from the chart in FIG. 3A which shows improved signal strength 310 of the invention in the 2000 Hz range as compared to natural middle ear filtering and consequent reduction in high frequency transmission to the inner ear.

The presence of high frequency hearing loss (hair cell loss) overlaps with the frequency range in which the middle ear becomes less and less sensitive. The result is loss of detectability and increased distortion with linear amplification. The audioboost in accordance with this embodiment uses middle ear resonance to amplify only those frequencies in the range of the impaired frequency function, and does so with less distortion.

Figure 4:
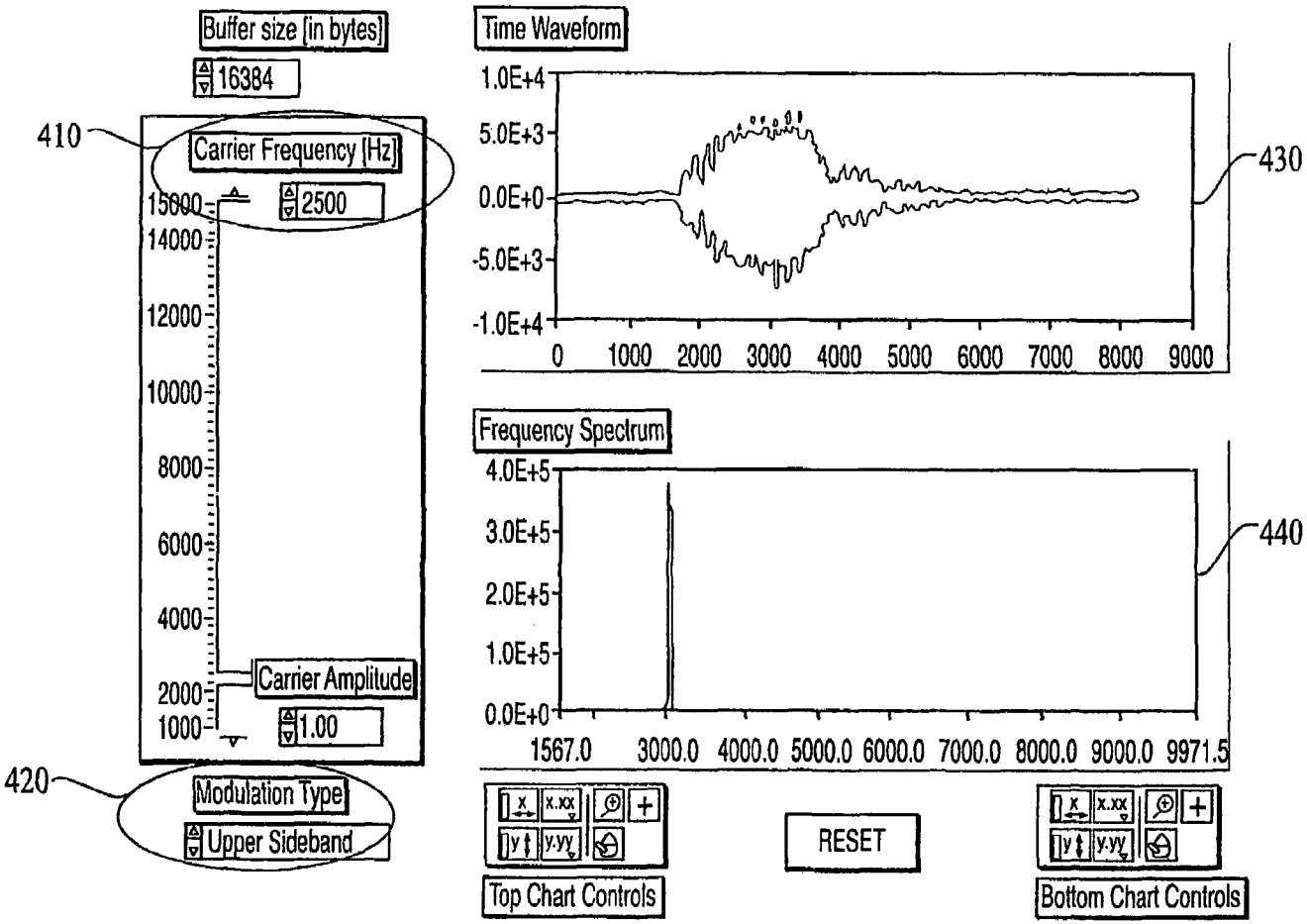
FIG. 4 is a spectrograph of a sample time waveform and frequency spectrum of an upper sideband modulated output of an auditory resonance frequency coupled device at a frequency of 2500 Hz.

Speech is filtered, modulated and presented as an acoustic pressure in the ear canal as either as a stand-alone device or as an adjunct to a hearing aid. The results are shown in FIG. 4. The carrier set at 2.5 kHz 410 is depicted in the lower panel 440. The speech is naturally amplified by the middle ear resonance reducing power considerations. The waveform and the spectrum of the modulated signal for the word "she" are depicted in the upper panel 430. The selected modulation type 420 is upper sideband.

The front end of standard hearing aids can be used with the air conduction driver of this embodiment acting as a miniature loud speaker, i.e. operating at resonance (lowest frequency). Prior art includes a disposable hearing aid that simply amplifies, an approach which is rejected by 80% of those with high frequency hearing loss. The modulated air conduction speech signal of this embodiment will be more likely to be accepted, and may be incorporated into disposable hearing aid architecture.

Acoustic Coupler for Skin Contact Hearing Devices

Air conduction hearing devices amplify sound in the ear canal and transmit through the eardrum ossicle route to the cochlea of the inner ear. Direct stimulation of the cochlea is possible by delivering vibration to the skin of the head or neck. However, there is an impedance difference between the vibrator and the skin that results in lost energy, which adversely affects use of modulation schemes for reaching the vestibular and auditory nerves. A coupler in accordance with the present invention allows some acoustic impedance matching between the vibrator and the skin, saving energy. This coupler will work with all frequencies transmitted to the head, and can be varied to optimize specific bands of the acoustic spectrum.

Skin contact hearing aids, to be efficient, must allow the flow of energy as unimpeded as possible into the body. Typically a transducer constructed of metal or plastic is affixed to the skin. Given the impedance differences between skin and the transducers, about 30% of the sound energy is lost. However adding a water interface between the skin and the transducer can increase the impedance match. Water has the same acoustic impedance as skin. The water filled bag is constructed of a biocomaptible material as Sylastic. The upper surface of the bag is bonded to the transducer, minimizing energy loss. The water depth is adjusted to ¼ wavelength, that is, the depth will vary with frequency.

In the prior art there is no water interface coupler for hearing aids. This is not a problem for most air conduction aids that couple by air to the tympanum. There are few bone conduction devices in use and some solve the problem by direct bone coupling. High frequency skin coupled hearing instruments are not common and the general prior art approach to impedance matching is increased power. Increased power can lead to overstimulation and heating.

The prior art provides the use of titanium skull screws which match the impedance of bone conduction devices, but this is invasive. Water coupling is often used with imaging technology in the Mhz range of acoustic stimulation, but this use is well above the frequencies usable for hearing near or in the ultrasound range (Lenhardt, 1991).

Figure 5:
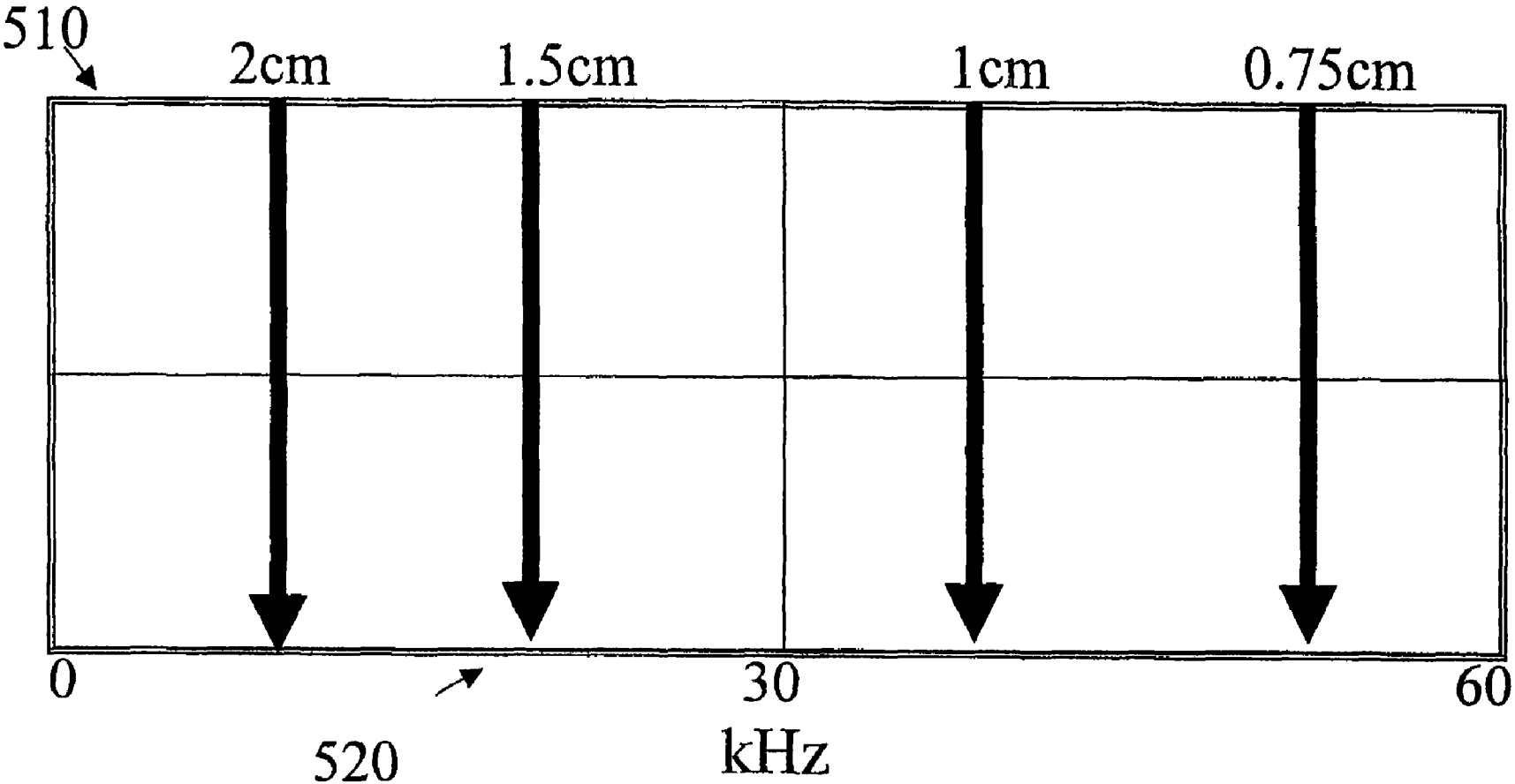
FIG. 5 is a nomograph showing wavelength versus frequency for a fluid impedance matcher at one-quarter wavelength.
Figure 6:
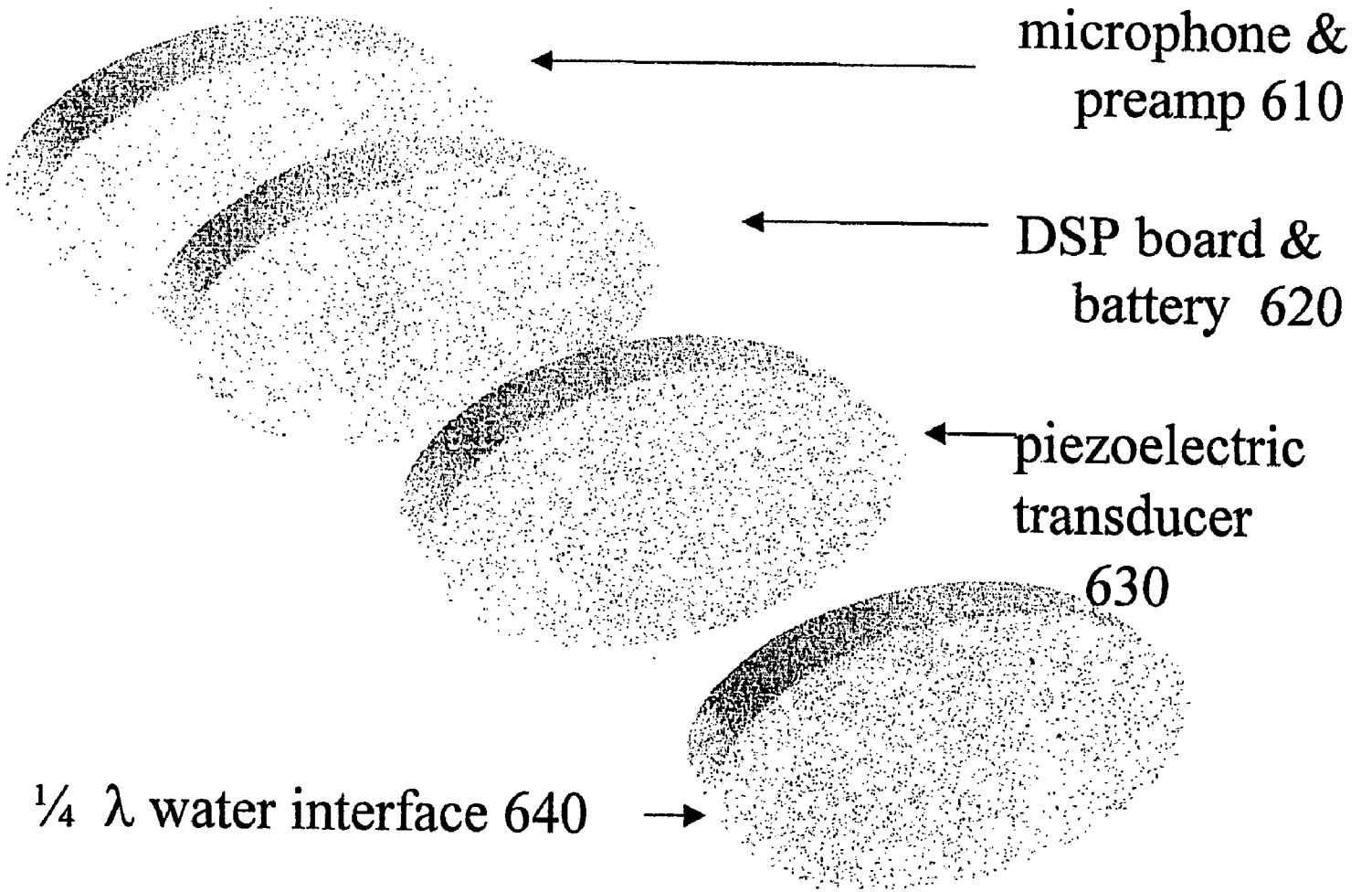
FIG. 6 is a diagram showing a stack approach to a skin contact hearing device with a fluid acoustic coupler.
Figure 7:
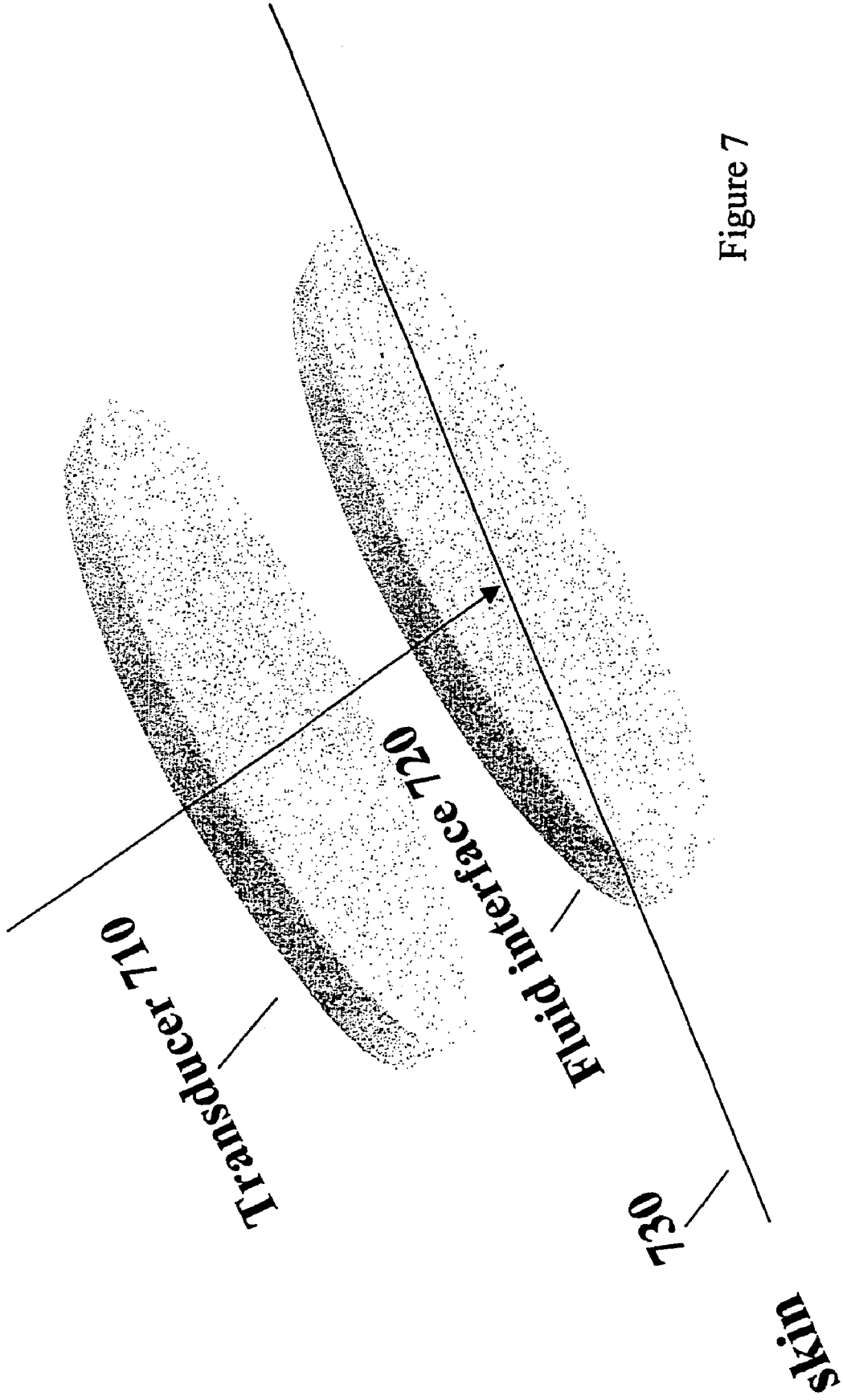
FIG. 7 is a schematic diagram showing the coupling relationship of a fluid interface between a transducer and a skin surface.

A nomogram showing the relationship, in an impedance matching water interface in accordance with the invention, between the thickness of the interface in centimeters (along scale 510) and the frequency in Hertz (Hz) output from the transducer (along scale 520) is shown in FIG. 5. FIG. 6 shows an embodiment of the invention as a stack consisting of a microphone and preamp 610, a digital signal processor (DSP) board and battery 620, a piezoelectric transducer 630 and a one-quarter wavelength water interface 640. FIG. 7 shows how the fluid interface 720 between the transducer 710 and the skin surface 730, with the transducer 710 being bonded or "welded" to the fluid interface 720 which matches acoustic impedances, provides efficient coupling that translates to less power requirements.

Figure 8:
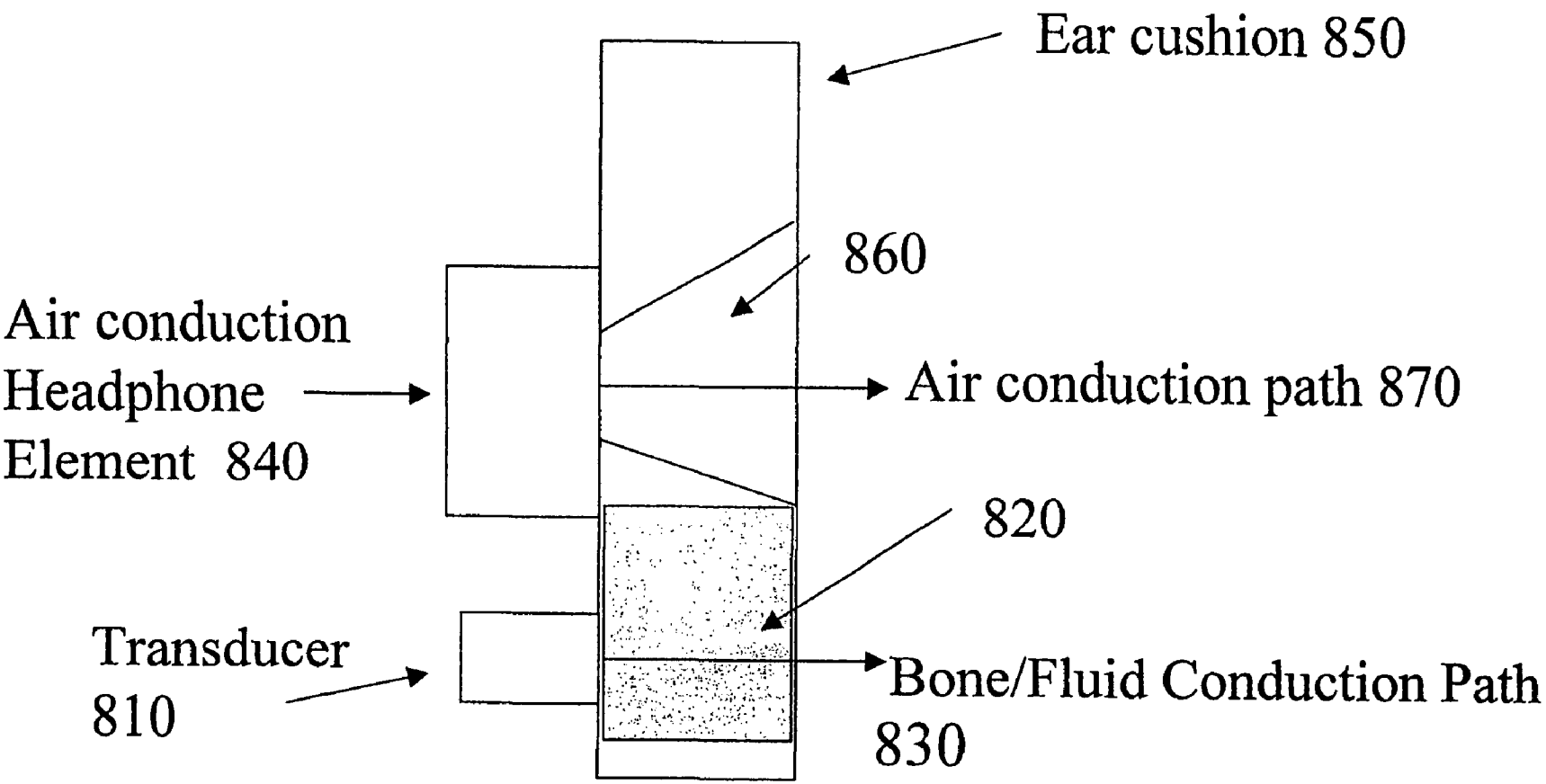
FIG. 8 is a schematic of a hearing device integrating air conduction and bone conduction elements.

One embodiment of this technology incorporates the invention into a headphone, as shown schematically in FIG. 8, to provide extended frequency response. Human hearing through air conduction has a limit of 20 kHz. Headphones also have a frequency response limited to 20 kHz. However, human hearing of sound directly coupled through bone conduction extends to 100 kHz, and new audio devices (e.g., DVD players) have been developed that have frequency responses extending well into this ultrasonic range (to 88 kHz). The embodiment of the fluid-filled acoustic coupler shown in FIG. 8 provides a novel way to allow perception of the extended frequency response.

This embodiment is a headphone-mounted coupling assembly that couples a bone conduction transducer 810 to the head through a fluid impedance matching cushion 820 which couples to bone conduction path 830 for perception by the brain. This allows hearing of high audio and ultrasonic frequencies beyond the range of the headphones, but within the range of bone conduction hearing. In the embodiment shown, the coupling assembly (810 and 820) is an integral part of the headphone cushion 850 around the ear, such that it contacts the mastoid portion of the temporal bone (not shown) behind the ear, one of the sensitive spots for bone conduction hearing. The air conduction headphone element 840 operates in the conventional fashion, producing vibrations in air cavity 860 which go into the ear canal (not shown) and are sensed via air conduction path 870.

The principle is that there is an impedance mismatch between a piezoelectric or magnoconstrictive transducer and the head. As shown in FIG. 7, a fluid-filled cushion 720 of appropriate dimensions is used to match the impedance of the transducer 710 to the head at skin contact 730, improving the transfer of vibration. It also provides more comfortable coupling of the transducer to the head. Recent research has shown that the best "bone conduction" response actually comes from non-osseous coupling to the fluids in the head (Freeman et al., 2000; Sohmer et al., 2000).

In one embodiment, the headphones contain a crossover network to direct the higher frequencies to the piezoelectric transducer. For a true high fidelity psychoacoustic experience, there is a separate volume control on the headphones to control the air conduction/bone conduction balance. This device can be used in the home or in vehicles, and allows the use of the full frequency range of new electronic devices such as DVDs which cover this extended frequency range.

Low Audio Frequency Listening Using Ultrasonic Transposition

Another embodiment of the invention captures important low frequency sounds and transposes them on a low frequency ultrasonic carrier such that they are audible even in high ambient background noise. The human ear is poorly sensitive in the low frequencies (<100 Hz). Many important sounds are contained in the frequencies between 1 and 100 Hz. Unfortunately most ambient noise is in this spectrum and can mask even specialized digital signal processing techniques applied to low frequency signals. Very low frequencies can be transposed into the higher frequencies by using ultrasonic frequency modulation. The temporal qualities of the low frequencies remain intact, but the pitch is elevated well above the masking background noise.

Ultrasonic modulation elevates the pitch of speech without distorting its waveform. Listeners do not attend to the high frequency quality but to the waveform envelope for recognition. It must be emphasized that even individuals with severe deafness can comprehend ultrasonic speech, although not at the level of a listener with normal hearing. Most importantly, the speech is raised above much of the ambient noise ceiling. Hence it is almost not maskable (115 dB SPL just masks ultrasonic tone 5 dB above threshold).

These two features of ultrasonic processed speech—preserved waveform and resistance to masking—can be applied to other categories of listening. Signatures of military vehicles as helicopters and tanks are possible with sophisticated signal processing and real time tracking, but for ground personnel this is difficult under battle conditions of high ambient noise. If, however, the signatures are modulated on an ultrasonic carrier, the waveform remains intact and the resulting higher pitch moves the auditory target to "quiet channel" in the ear. Thus judgments of direction and distance can be made even under the high noise conditions.

Figure 9:
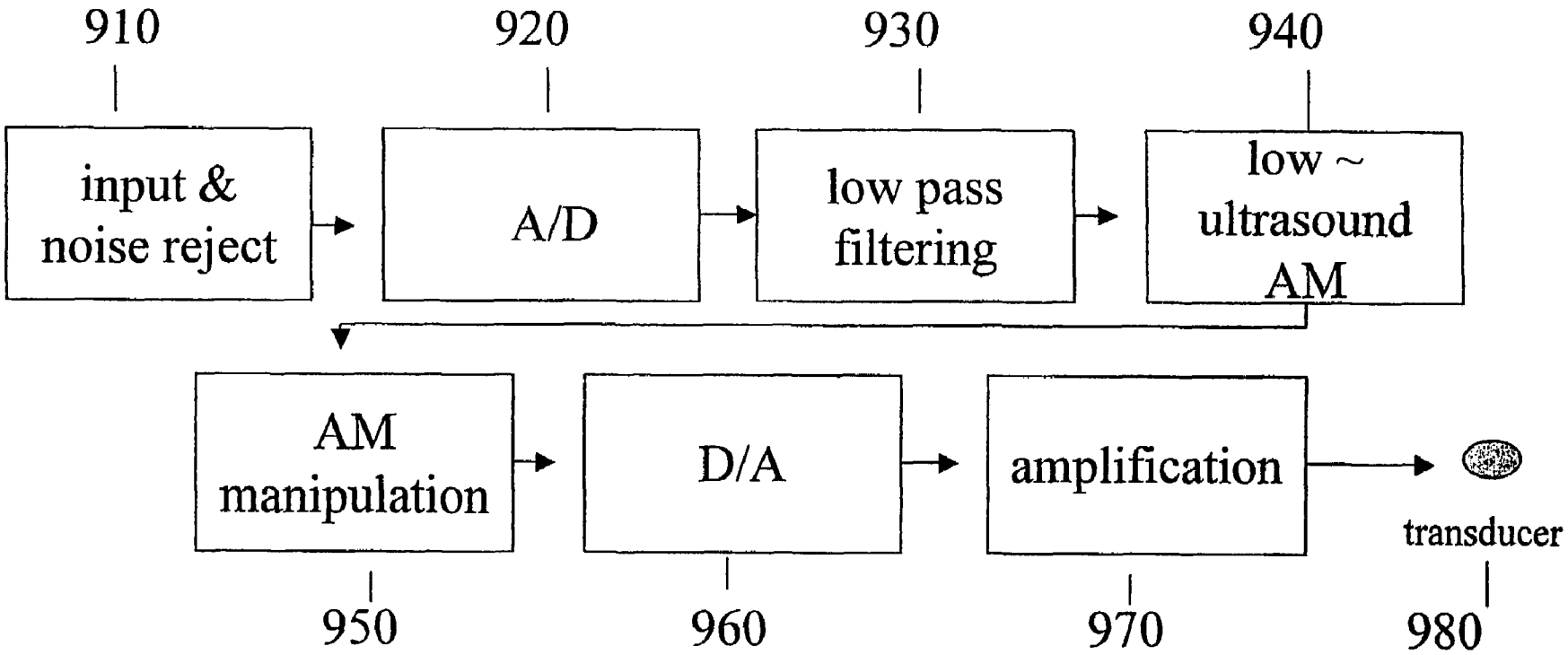
FIG. 9 is a flow diagram of a low audio frequency listening device using ultrasonic transposition.

The processing is depicted in FIG. 9. Sounds of interest (i.e. target signatures or acoustic footprints) are captured and enhanced 910 using currently available DSP techniques. The signal is then digitized 920, filtered 930 to identify the particular sounds of interest, and multiplied by an ultrasonic carrier 940 (or otherwise frequency shifted). The signal can be partially phase canceled filtered or otherwise manipulated 950 to ultimately improve human perception. Afterwards the signal is converted to an analog 960 and driven 970 via a vibrator 980 as vibration applied to the skin of the body (usually, the head or neck)

This invention shifts selected frequencies (below 200 Hz), frequency bands, or predefined spectral patterns (i.e. an acoustic signature for a particular vehicle) into the high sonic and ultrasonic quiet zone (10-100 kHz) for detection and recognition by the auditory system. Using the quiet zone overcomes the masking that occurs in noisy environments without the footprint, power consumption, and computations required by an active noise suppression system. The driving transducer 980 can be held in place with reusable contact tape. Discrete use is possible since there is little acoustic radiation into the air. Any airborne ultrasound is readily attenuated. There are no visual or manipulative distractions, and all the existing advantages of the auditory system are retained.

In an alternate embodiment, the sensor may also be integrated into a more comprehensive hearing protection/active noise suppression system using headphones or helmet mounted speakers/actuators. This "wearable" device may be attached by adhesive to the skin of the head or neck which couple to the auditory system, placed on/in the ear, or mounted on a helmet. All information is communicated to the user through the auditory system.

Auditory distance can be coded by sensing an increase or decrease in the amplitude of the transmitted signal, which indicates the relative range of a source. The dynamic range of ultrasound is compressed such that loudness can increase rapidly. Since ultrasound is resistant to masking and loudness is a very salient cue, detection and distance judgments are very reliable during vigilance tasks. Selected frequencies from the spectrum of a known source (e.g., vehicle, weapon, machine) can be shifted into the quiet zone for detection. The user would be trained to recognize these signature alarm patterns. Encouraged by the observations that the deaf—who have not benefitted from power hearing aids—can learn to detect and discriminate ultrasonic words after only a few hours of training, learning with this technology is anticipated. Discrimination appears to improve with ultrasound experience, suggesting the brain's plasticity plays a role in learning.

Figure 10:
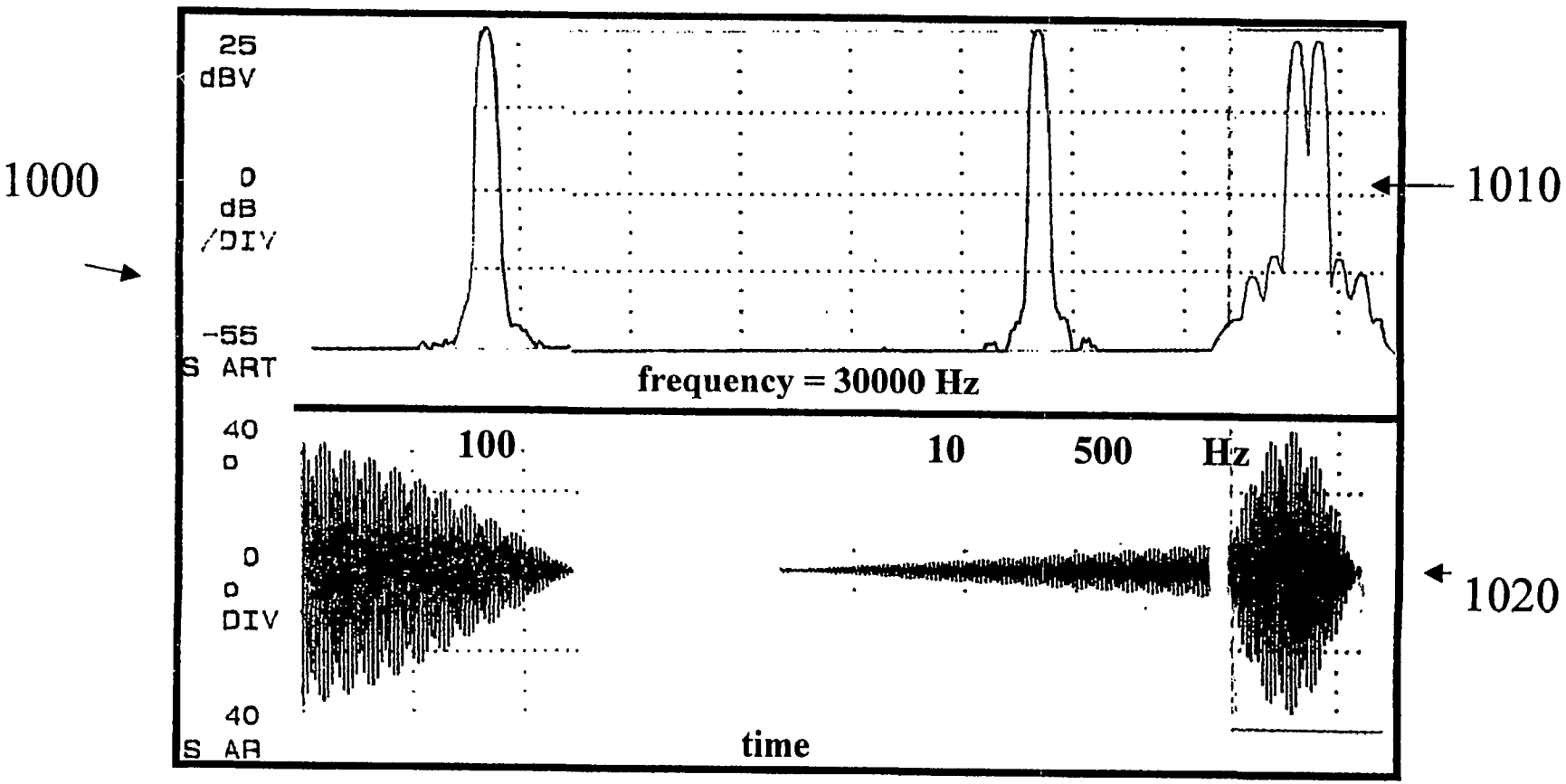
FIG. 10 is a spectral analysis chart showing carrier and modulator output attributes for ultrasonic modulation of low frequencies in high noise.

The spectral 1010 and time 1020 signal parameters of tones at 100, 10 and 500 Hz are presented in the spectral analysis chart 1000 of FIG. 10. This is an example of the signal that will be applied to the skin of the head or neck. All signals have the same amplitude but different tune windows (time is directly related to frequency).

Figure 11:
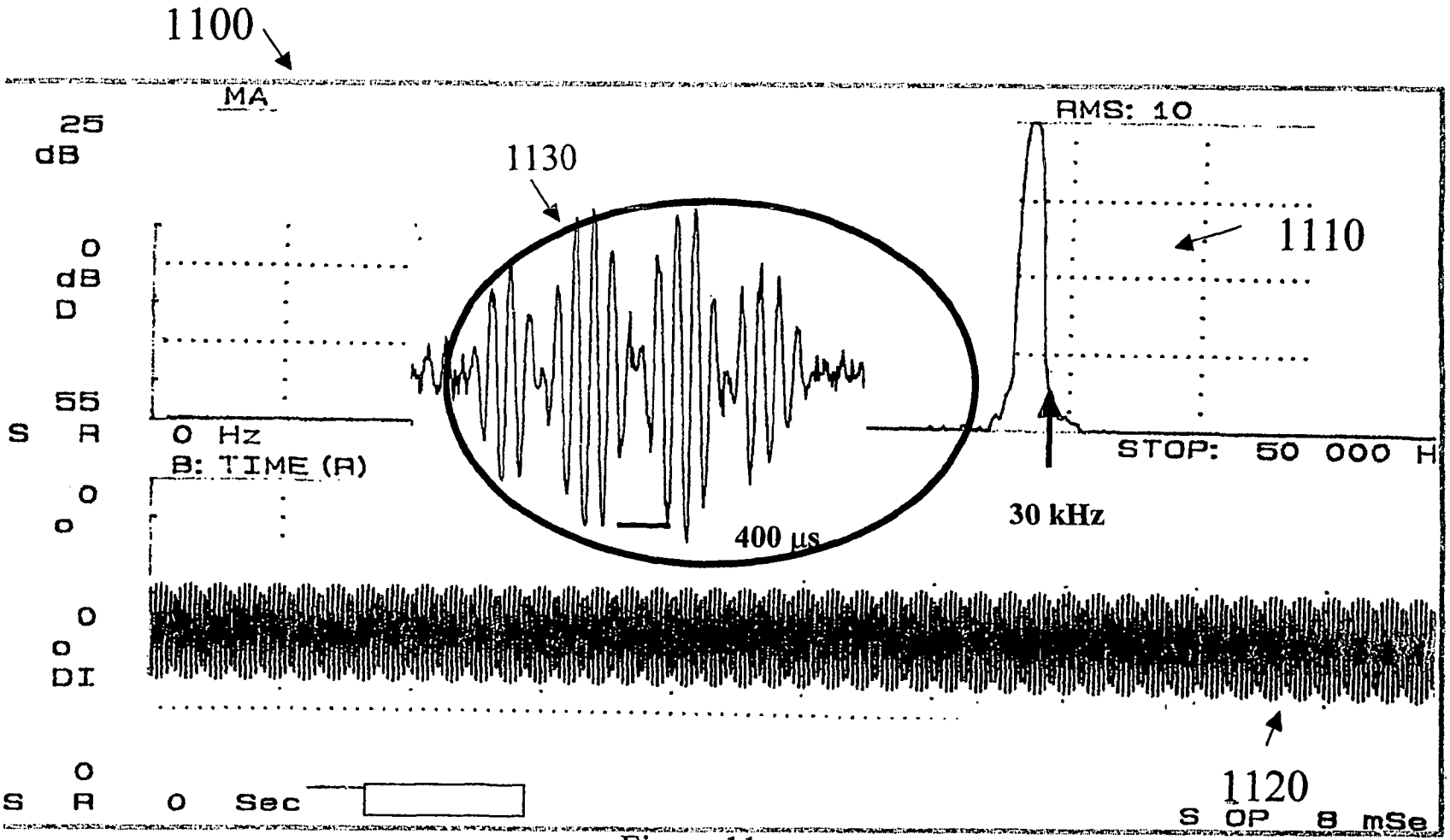
FIG. 11 is a spectral analysis chart showing infra sound at 2 Hz modulated by a 30 kHz ultrasound carrier.

Subjects can readily detect infra-sound using this technique. Although the lower limit of hearing is accepted to be 20 Hz, typically defined as the lower Unit of pitch, infrasonic frequencies are important in defining military signature as in the case of helicopters and can be made audible with pitch using this invention. By modulating one or two Hertz by an ultrasonic carrier, clear auditory perception will occur, as shown in the spectral analysis chart 1100 of FIG. 11. A 30 kHz carrier 1110 is modulated by a 2 Hz signal, producing a modulated signal 1120. Detail of the modulated signal is shown in the cutout 1130. This technology can be used to listen to any infrasonic source from weather to helicopter. Typically, bone conducted sound results in a bilateral perception which inhibits localization. Localization is possible with this invention because the carrier chosen will be matched to the geometry of the head and will be silent at one ear and active at another. The applications include military monitoring, surveillance and underwater applications.

While the invention has been described in terms of preferred embodiments, those skilled in the art will recognize that the invention can be practiced with modification within the spirit and scope of the appended claims.

The invention claimed is:

1. An acoustically coupled skin contact hearing enhancement device, comprising:

an input device for acoustic signals;

a digital signal processor for converting an analog output from said input device;

a piezoelectric transducer for converting an output from said signal processor to a mechanical vibration; and a water interface, said water interface being applied between said transducer and an external skin contact, wherein said water interface provides a separation distance between said transducer and said skin contact, said separation distance being adjusted to provide an impedance match at a selected frequency between said transducer and said skin contact.

2. The hearing enhancement device of claim 1, wherein said water interface is a bag constructed of a biocompatible material and wherein said bag is bonded to said transducer.

3. The hearing enhancement device of claim 1, wherein said skin contact is at the mastoid portion of the temporal bone behind the ear.

4. The hearing enhancement device of claim 3, further comprising a headphone having an earpiece, said hearing enhancement device being mounted in said earpiece.

5. The hearing enhancement device of claim 4, further comprising a volume control, wherein said headphone contains a crossover network for directing higher frequencies to said piezoelectric transducer and said volume control is used to control output from said piezoelectric transducer.

6. The hearing enhancement of claim 5, wherein said higher frequencies are in the supersonic range.

* * * * *